United States Patent [19]

Fieschi et al.

[11] Patent Number: 4,827,857

[45] Date of Patent: May 9, 1989

[54] CYLINDRICAL BED SEWING MACHINE

[75] Inventors: Giorgio Fieschi, Buccinasco; Raffaele Angiolicchio, Cesano Boscone, both of Italy

[73] Assignee: Rockwell-Rimoldi S.P.A., Olcella, Italy

[21] Appl. No.: 238,742

[22] Filed: Aug. 31, 1988

[30] Foreign Application Priority Data

May 30, 1988 [IT] Italy ..... 20802 A/88

[51] Int. Cl.[4] ..... D05B 21/00; D05B 35/02; D05B 35/06

[52] U.S. Cl. ..... 112/121.26; 112/121.27; 112/138; 112/141

[58] Field of Search ..... 112/121.26, 121.27, 112/137, 138, 152, 141, 143, 136

[56] References Cited

U.S. PATENT DOCUMENTS

| | | | |
|---|---|---|---|
| 1,289,127 | 12/1918 | De Voe | 112/152 |
| 2,313,261 | 3/1963 | Podgorny | 112/152 |
| 2,506,325 | 5/1950 | Ackerman | 112/138 |
| 2,761,401 | 9/1956 | Dolney | 112/152 |
| 3,219,002 | 11/1965 | Levy | 112/121.26 |
| 3,548,767 | 12/1970 | Williams | 112/152 |
| 3,699,909 | 10/1972 | Gawel | 112/152 |
| 4,037,547 | 7/1977 | Marjorio | 112/121.27 |
| 4,703,706 | 11/1987 | Plante | 112/121.26 X |

*Primary Examiner*—H. Hampton Hunter

*Attorney, Agent, or Firm*—Laff, Whitesel, Conte & Saret

[57] ABSTRACT

The sewing machine herein described comprises a hem folder 9 arranged to introduce an elastic band into the folded edges of a workpiece and a feed guide 16 arranged to apply ribbon-like trimmings along the edges of the same workpiece. The hem folder is oscillatably connected to the machine bed 2 and is movable, upon command of a fluid-operated cylinder 15, from a working position in which it is disposed flush with the workpiece supporting table 3 and before the presser foot 7 to a rest position in which it is tilted in front of the bed and disposed at a lower position than the supporting table. The feed guide which is connected to the machine bed by a rotary fluid-operated cylinder 20, is movable from a rest position in which it is spaced apart sideways from the supporting table 3 to a working position in which it has a free end **16*a*** disposed before the presser foot.

5 Claims, 2 Drawing Sheets

CYLINDRICAL BED SEWING MACHINE

BACKGROUND OF THE INVENTION

1. Field of the Invention

The present invention relates to a cylindrical bed sewing machine, of the type comprising a machine bed on which a workpiece supporting table is defined, along said table a workpiece being caused to move by means of feed dogs acting flush with the supporting table, a standard rising from the machine bed and supporting an arm in cantilevered fashion, which arm terminates in a head disposed above the supporting table, a presser foot elastically supported by the head and acting upon the feed dogs to push the workpiece against the latter and sewing means acting in the vicinity of the pressure foot to sew the workpiece.

2. Prior Art

It is known that when garments and the like have to be produced it is provided in many cases that hemmings should be carried out along some edges of the workpiece with the optional introduction of elastic bands and that ribbon-like trimmings should be applied to other edges of the workpiece for aesthetic and/or support purposes. For example when a pair of trousers is being manufactured it is usually necessary to carry out a hemming along the circumferential waist extension of the same, optionally introducing an elastic band thereinto, as well as the application of support and ornament tapes along the lower edges of the legs.

The execution of these operations presently needs the use of two different sewing machines and, as a result, of two distinct working steps. In greater detail, to carry out hemmings with the optional introduction of an elastic band a cylindrical base sewing machine can be used which is equipped with an appropriate hem folder arranged on the workpiece supporting table, before the presser foot. Said hem folder is shaped in such a manner that it slidably engages one edge of the workpiece and guides it in a longitudinally folded condition beneath the presser foot during the execution of stitching. Said hem holder may also engage, together with the workpiece edge, an elastic band previously fitted on support rollers distributed around the machine bed, so that while the line of stitching is being carried out the elastic band is enclosed within the fold formed with the workpiece edge.

The application of ribbon-like trimmings, such as tapes, neck-bands and the like is in turn accomplished by other sewing machines which, in place of said hem folder, are equipped with a feed guide extending below the sewing machine arm and having a free end disposed before the presser foot, flush with the workpiece supporting table. Said feed guide suitably shaped is adapted to slidably engage the ribbon-like piece of trimmings, folding it in a longitudinal direction and disposing it astride of the workpiece edge immediately upstream of the pressure foot. The piece of trimmings is then sewn along the workpiece edge upon the action of the sewing members operating in the vicinity of the presser foot.

At the end of stitching the piece of trimmings is cut downstream of the presser foot in such a manner that an end portion thereof is clamped under the pressure foot and can therefore be easily engaged by the edge of the next workpiece.

Although the above described machines are perfectly adapted to perform their functions, it is noted that, since it is necessary to carry out the above operations during distinct working steps, there is an increase in the production time and man-power costs which adversely affects the cost of the finished product.

SUMMARY OF THE INVENTION

The main object of the present invention is to solve the above specified drawback by providing a cylindrical bed sewing machine equipped with both the hem folder and feed guide and therefore capable of performing both said operations.

Due to the fact that both the hem folder and feed guide act in front of the presser foot and flush with the workpiece supporting table, a further problem must first of all be faced that is the coexistence of said members without causing one member to jeopardize the practicality of use and/or efficiency of operation of the other. It is also to be noted that, since the two members have to be alternatively used during the manufacture of a single workpiece, it will be no longer possible to hold the piece of trimmings engaged under the presser foot at the end of working. So at the present state of the art it would be necessary to carry out awkward operations for the engagement of the piece of trimmings to a new workpiece when the feed guide should be used again.

It is therefore a further object of the present invention to automatically achieve a correct insertion of ribbon-like trimmings under the presser foot each time the feed guide must be used, in order to facilitate the operations to be performed for the initial engagement of the workpiece edge with the trimmings.

The foregoing and still further objects which will become more apparent in the course of the present invention are substantially achieved by a cylindrical base sewing machine, comprising a hem folder mounted on a support pivoted to the machine bed according to a substantially horizontal pivoting axis and at right angles to the workpiece feed direction on the supporting table, said support being oscillatable about its own pivoting axis to bring the hem folder from a use position in which it is disposed flush with the supporting table and before the presser foot to a rest position in which it is tilted in front of the machine bed and disposed in a lower position than the supporting table, and a feed guide which is fixedly engaged with a support element rotatably connected to the machine bed according to a substantially vertical axis of rotation and can oscillate angularly about said axis of rotation to bring the feed guide from a rest position in which it is spaced apart sideways from the supporting table to a working position in which it has a free end disposed in front of the presser foot to feed ribbon-like trimmings thereunder, said trimmings being slidably engaged along the feed guide itself.

BRIEF DESCRIPTION OF THE DRAWINGS

Further features and advantages will best be understood from the detailed description of a preferred embodiment of a cylindrical base sewing machine in accordance with the present invention, given hereinafter by way of non-limiting example with reference to the accompanying drawings, in which.

DESCRIPTION OF THE PREFERRED EMBODIMENT

Figure 1:
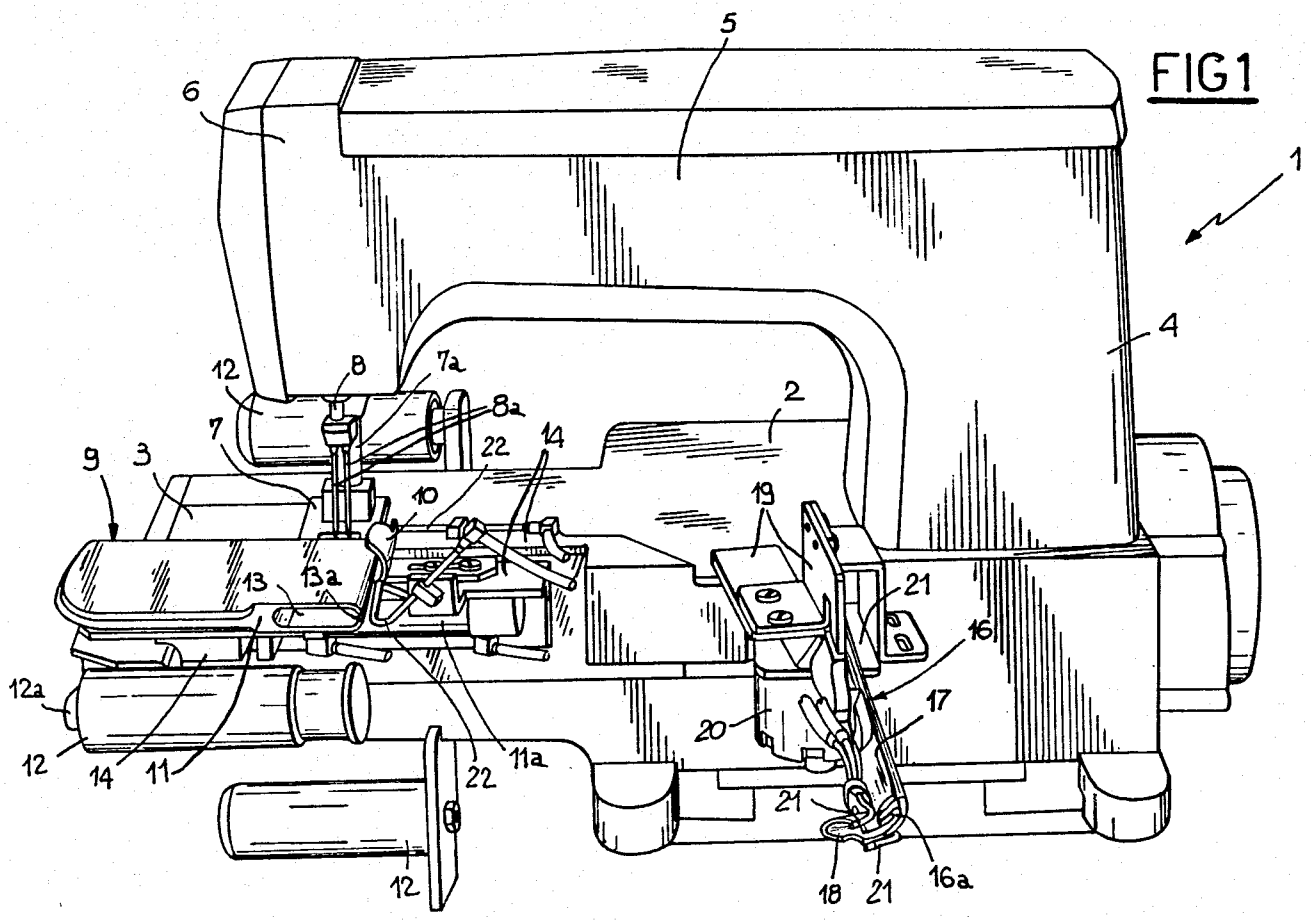
FIG. 1 is a front perspective view of the sewing machine in accordance with the invention, in which a hem folder is shown in a use position and a feed guide is shown in a rest position.

Referring to the drawings, a cylindrical bed sewing machine in accordance with the invention has been globally identified by reference numeral 1. In a manner known per se, the sewing machine 1 comprises a bed 2 defining a workpiece supporting table 3 at the top, on which surface a workpiece not shown is fed by means of feed dogs (not shown) acting flush with the supporting table. A standard 4 rises from one bed side and supports an arm 5 in cantilevered fashion which in turn carries a head 6 at its free end, said head being disposed above the supporting table 3. Mounted in the head 6 is a presser foot holder 7*a* carrying a presser foot 7 at the lower part thereof, which presser foot, due to the elastic action exerted on the foot holder, is pushed towards said feed dogs to urge the workpiece against the latter. Also mounted in the head 6 is a needle bar 8 carrying one or more needles 8*a* at the lower part thereof, which perform the lines of stitching on the workpiece in combination with other known sewing means acting through the supporting table 3 and in the vicinity of the presser foot 7.

The sewing machine 1 is advantageously equipped with a hem folder 9 which in known manner is adapted to act flush with the supporting table 3 and in front of the presser foot 7 to engage one edge of the workpiece and suitably fold it guiding it under the presser foot during the execution of the stitching. In a manner known per se the hem folder 9 comprises a fixed portion 10 and a movable portion 11, designed to move apart from and close to the fixed portion 10, preferably upon the action of a fluid-operated cylinder 11*a*, for the purposes to be clarified later.

Preferably the hem folder 9 is also arranged in such a way that it slidably engages an elastic endless band (not shown) fitted on support rollers 12 suitably distributed around the machine base 2. To this end in the movable portion 11 of hem folder 9, adjacent the fixed portion 10, is formed a tubular housing 13 adapted to engage the elastic band portion extending upstream of the presser foot 7 through a longitudinal slit 13*a* oriented towards the fixed portion.

Figure 2:
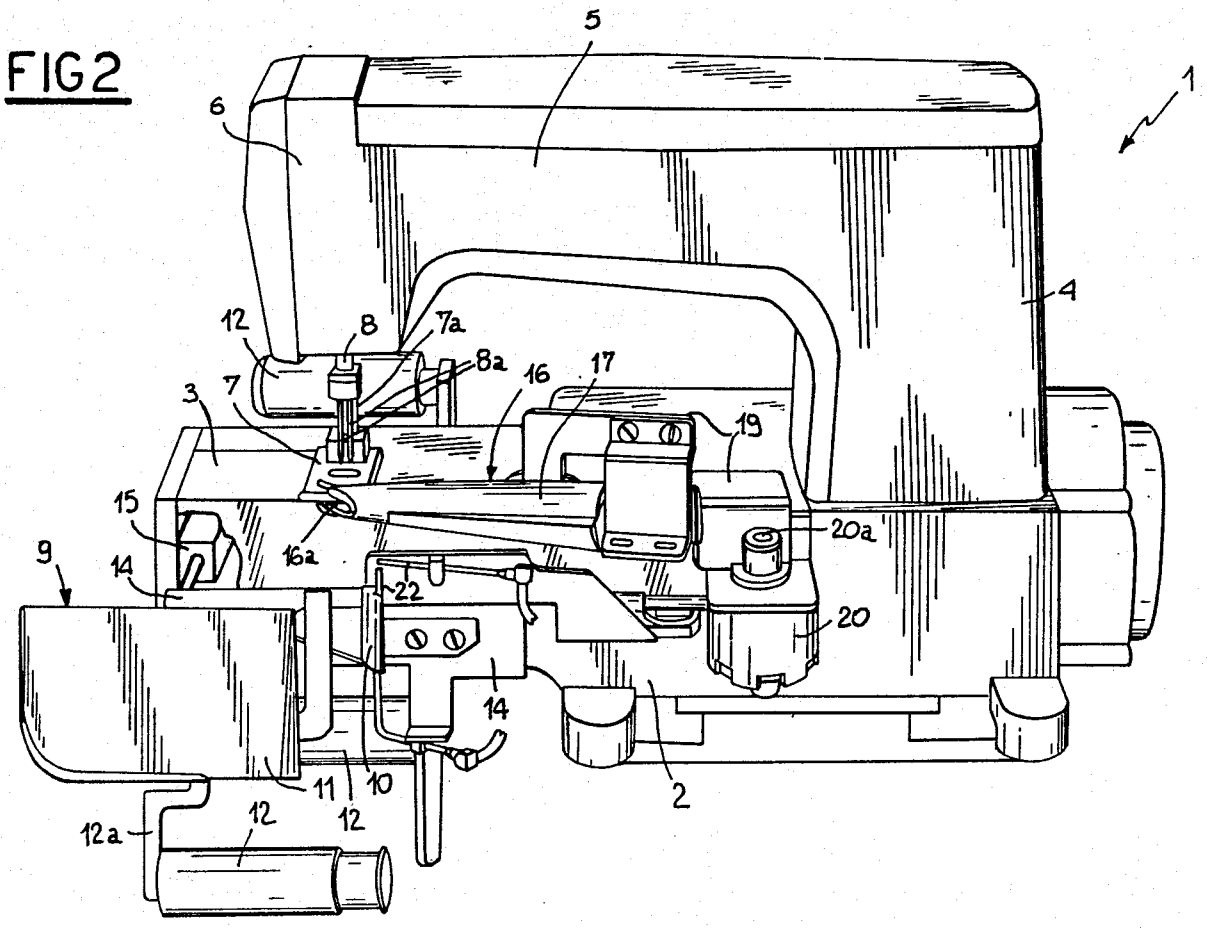
FIG. 2 is a front perspective view of the sewing machine in which the hem folder is in a rest position and the feed guide is in a working position.

In an original manner the hem folder 9 is advantageously mounted on a support 14 pivoted to the front part of the machine bed 2 according to a substantially horizontal axis at right angles to the feed direction of the workpiece on the supporting table 3. The support 14 can oscillate, preferably upon command of a fluid-operated positioning cylinder 15 housed in the machine bed 2, so that the hem folder 9 can be brought from a use position in which, as shown in FIG. 1 and previously mentioned, it is disposed flush with the supporting table 3 and in front of the presser foot 7, to a non-use position in which, as shown in FIG. 2, said hem folder is tilted in front of the machine bed and is disposed in a lower position than the supporting table 3.

Preferably connected to the support 14 through a bracket 12*a* is also a roller 12 adapted to engage the elastic band in front of the hem folder 9, so that said roller moving together with the hem folder may be disposed below the machine bed 2 when the hem folder is brought to its non-use position.

In accordance with the present invention the sewing machine 1 further comprises a feed guide 16 designed to slidably engage a ribbon-like piece of trimmings such as for example a tape, neck-band and the like (not shown) in such a manner that during the execution of the line of stitching the piece of trimmings is suitably folded in a longitudinal direction and sent under the presser foot 7 in engagement relationship with the edge of the workpiece.

To this end, in a manner known per se, the feed guide 16 exhibits a tubular structure 17 the section of which varies without interruption so that the piece of trimmings while travelling along the tubular structure towards a free end 16*a* of the feed guide 1 is folded according to the desired conformation. Disposed at the outlet of the tubular structure 17, that is in that vicinity of said free end 16*a*, is a substantially U-shaped element 18 is designed to engage the piece of trimmings together with the edge of the workpiece to cause the piece of trimmings to be disposed and sewn astride of said edge.

In an original manner, the feed guide 16 is fixedly engaged to a support element 19 which is connected to the machine bed 2 with possibility of rotating about a vertical axis, preferably disposed in the vicinity of the standard 4. In the example shown the support element 19 is mounted on a drive shaft 20*a* (FIG. 2) exhibited by a rotary fluid-operated cylinder 20 fastened to the bed 2 by means of an attachment bracket 21. Said rotary fluid-operated cylinder is capable of causing the angular oscillation of the support element 19 about its pivoting axis, that is about the axis of the drive shaft 20*a*, so that the feed guide 16 is brought from a rest position in which, as shown in FIG. 1, it is spaced apart sideways from the supporting table 3, to a working position in which, as shown in FIG. 2, it has its free end 16*a* located before the presser foot 7, flush with the supporting table 3.

In addition, associated with the feed guide 16 is at least a pneumatically-operated blowing nozzle 21 which through known conventional means produces an air blow directed from the free end 16*a* towards the presser foot 7 when the feed guide is brought to its working position, to the ends to be described later.

Preferably, as shown in FIG. 1, provision is made for at least two blowing nozzles 21 ending close to the opposite sides of the shaped element 8 respectively.

Operation of the sewing machine according to the invention described above mainly as regards structure, is as follows.

When it is necessary to execute a hemming along the edge of a workpiece with the insertion of an electric band therein, the positioning cylinder 15 is operated for example upon command of an operator by means of a foot control lever or a knee control lever or upon command of an electronic control unit associated with the sewing machine, both said devices being known and therefore not described herein, so that the hem folder 9 is brought to its use position, as shown in FIG. 1. At the same time the rotary cylinder 20, upon command of said electronic control unit or a microswitch associated with the support 14 of the hem folder 9, acts in such a way that the feed guide 16 is held in a rest position. Under this situation, the hem folder 9 can be used in a conventional manner to execute the requested stitching. In greater detail, upon command of the fluid-operated cylinder 11a, the movable portion 11 is moved apart from the fixed portion 10 and consequently the elastic band to be applied to the workpiece can be easily fitted on the support rollers 12 and inserted beneath the presser foot 7. The movable portion 11 is then moved close to the fixed portion 10 and the elastic band portion disposed upstream of the presser foot 7 is engaged in the tubular housing 13 through the slit 13*a*.

Afterwards the workpiece edge is folded around the movable portion 11, in the space defined between the latter and the fixed portion 10. At this point the line of stitching is carried out and during said stitching the workpiece edge, guided between the fixed and movable portions 10 and 11 possibly with the aid of auxiliary blowing nozzles 22, will be folded around the elastic band and fixed thereto by stitching means acting close to the presser foot 7. When the stitching is about to come to an end, the movable portion 11 is again moved apart from the fixed portion 10 to disengage the elastic band from the tubular housing 13 and allow the completion of the stitching.

On the contrary, when ribbon-like trimmings have to be applied along one edge of the workpiece, the hem folder 9 is disposed in its non-use position by the action of the positioning cylinder 15 to make room for the free end 16*a* of the feed guide 16 which, being acted upon by the rotary cylinder 20, is brought to its working position.

When the free end 16*a* comes in front of the presser foot 7, air is sent to the blowing nozzles 21 associated with the feed guide 16. In this manner the piece of trimmings previously engaged through the feed guide 16 is slightly touched by the air blows produced by nozzles 21 in the region of an end portion thereof projecting from the free end 16*a* and, as a result, it is oriented so as to be inserted under the presser foot 7.

Under this situation the piece of trimmings is adapted to be easily engaged by the workpiece edge when the latter, being acted upon by the operator, will be engaged through the shaped element 8 and under the presser foot 7 in order to start stitching.

At the end of sewing, the piece of trimmings is automatically cut downstream of the presser foot 7 by cutting means known per se and conventional, so that the end portion thereof projecting from the free end 16*a* of guide 16 will be held in engagement under the presser foot.

In this manner the piece of trimmings can be easily engaged by another workpiece edge, should further trimmings need to be applied. If on the contrary a new hemming operatiton with the insertion of an elastic band or not, is necessary, the feed guide 16 will be brought again to its rest position to make room for the hem foldler 9 which in turn will reach its working position.

The present invention attains the intended purposes.

In fact, the present sewing machine is capable of executing both hemming operations with the insertion of an elastic tape or not, and sewing operations aiming to apply ribbon-like trimmings such as tapes, neckbands and the like to the edges of a workpiece. As compared with known art, this solution allows a workpiece to be much less handled during its manufacture, which involves a reduction in the production time and consequently in the man-power costs.

It is also to be noted that the simultaneous presence of the hem folder 9 and feed guide 16 does not bring about any limitation as regards the practicality of use and good operation of said members. In fact, as is apparent from the above description, the member which is not used is moved away from the area in front of the presser foot so that the use of the other member is not hindered.

Furthermore and advantageously, the presence of the blowing nozzles 21 on the free end of the feed guide 16 eliminates the necessity of operating manually to achieve the initial insertion of a ribbon-like piece of trimmings under the presser foot, so that the engagement between the workpiece edge and the piece of trimmings is made easier.

Obviously, many modifications and variations can be made to the present invention, all falling within the scope of the invention idea characterizing it.

What is claimed is:

1. A cylindrical bed sewing machine, of the type comprising:

a machine bed on which a workpiece supporting table is defined, along said table a workpiece being caused to move by means of feed dogs acting flush with the supporting table;

a standard rising from the machine bed and supporting an arm in cantilevered fashion, which arm terminates in a head disposed above the supporting table;

a presser foot elastically supported by the head and acting upon the feed dogs to push the workpiece against the latter;

sewing means acting in the vicinity of the presser foot to sew the workpiece;

and further comprising:

a hem folder mounted on a support pivoted to the machine bed according to a substantially horizontal pivoting axis and at right angles to the workpiece feed direction on the supporting table, said support being oscillatable about its own pivoting axis to bring the hem folder from a use position in which it is disposed flush with the supporting table and before the presser foot to a rest position in which it is tilted in front of the machine bed and disposed in a lower position than the supporting table; and a feed guide which is fixedly engaged with a support element rotatably connected to the machine bed according to a substantially vertical axis of rotation and can oscillate angularly about said axis of rotation to bring the feed guide from a rest position in which it is spaced apart sideways from the supporting table to a working position in which it has a free end disposed in front of the presser foot to feed ribbon-like trimmings thereunder, said trimmings being slidably engaged along the feed guide itself.

2. A sewing machine as claimed in claim 1, wherein associated with said feed guide is at least a blowing nozzle acting so as to produce an air blow directed from said free end towards the presser foot when said feed guide is brought to a working position.

3. A sewing machine as claimed in claim 1, wherein associated with the support of said hem folder is a roller acting in front of the hem folder itself in cooperation with other rollers distributed around the machine bed to support an elastic band engaged in said hem folder and ready to be applied to the workpiece.

4. A sewing machine as claimed in claim 1, wherein the hem folder is brought from its use position to its rest position upon the action of a fluid-operated cylinder housed in the machine bed and acting upon said support.

5. A sewing machine as claimed in claim 1, wherein said feed guide is moved from its rest position to its working position upon the action of a rotary fluid-operated cylinder to the rod of which the support element of said feed guide is fastened.

* * * * *